United States Patent [19]

Stewart et al.

[11] 4,071,993

[45] Feb. 7, 1978

[54] CONSTRUCTION MATERIAL IN SHEET FORM AND METHOD OF JOINING SHEETS EDGE-TO-EDGE

[75] Inventors: Sherman A. Stewart, Palos Verdes Peninsula, Calif.; Estel Ray Snyder, La Grange, Ill.

[73] Assignee: Grefco, Inc., Bala Cynwyd, Pa.

[21] Appl. No.: 702,966

[22] Filed: July 6, 1976

[51] Int. Cl.[2] ..... E04C 2/10; E04B 7/00

[52] U.S. Cl. ..... 52/309.5; 52/417; 52/435; 52/496

[58] Field of Search ..... 52/309, 338, 328, 302, 52/303, 416, 417, 418, 419, 495, 496, 309.4, 309.5, 743, 746, 434, 435

[56] References Cited

U.S. PATENT DOCUMENTS

| | | | |
|---|---|---|---|
| 3,182,423 | 5/1965 | Jennings | 52/417 |
| 3,203,146 | 8/1965 | Carter | 52/302 |
| 3,308,586 | 3/1967 | Olson | 52/144 |
| 3,672,951 | 6/1972 | Moore | 52/309 |
| 3,958,373 | 5/1976 | Stewart | 52/309 |
| 3,962,841 | 6/1976 | Carroll | 52/309 |

*Primary Examiner*—John E. Murtagh

*Attorney, Agent, or Firm*—Everett H. Murray, Jr.; Brian G. Brunsvold; Bruce C. Zotter

[57] ABSTRACT

A construction material in sheet form having at least two water barriers including a water-impermeable foamed intermediate layer, a mineral-based interior layer, and a prefinished, weatherable, water-impermeable non-asphaltic outer layer, with adjoining layers firmly adhered. Sheets of the construction material having a foamed intermediate layer and mitered edges exposing the foamed layers are joined by the steps of positioning the sheets with the mitered edges abutting opposite sides of the stem of a bulb-T rafter, the sheets being supported by the cross-member of the bulb-T rafter, forming a foam filler in the cavity created by the abutted mitered edges, and sealing the cavity with weatherable tape. A roof deck for use with bulb-T rafters, the roof deck constructed of the aforementioned sheets joined by the aforementioned method is also shown.

8 Claims, 2 Drawing Figures

CONSTRUCTION MATERIAL IN SHEET FORM AND METHOD OF JOINING SHEETS EDGE-TO-EDGE

BACKGROUND OF THE INVENTION

1. Field of the Invention

This invention pertains to a construction product in sheet form for roof decks and related applications, to a method of joining the sheets, and to roof decks composed of the sheets joined according to the invention.

2. Description of the Prior Art

Multilayered construction material in sheet form, having a mineral-based inner layer and a foamed plastic intermediate layer, for use in roof decks and related applications are known in the industry. The U.S. Pat. No. 3,889,836 to Payne shows such a building component comprising a glass fiber-reinforced gypsum inner layer, a foamed polyisocyanurate or polyurethane intermediate layer, and an outer layer of water-resistant sheet of sanded bituminized roofing felt. Upon application or assembly, the sheetsor panels disclosed in Payne are joined and then the joined panels are covered with two or more layers of the sanded bituminized roofing felt, thus giving rise to the term "built-up roofing" used to describe this type of construction. Built-up roofing is currently a standard technique for waterproofing in the industry.

Current products for the roof deck market do not solve two major, interrelated problems that accompany the use of the "built-up roofing" technique, namely (1) the necessity to employ on-site finishing of the panels or assembled roof deck, and (2) the reliance on hot-asphalt-type finishing materials.

On-site finishing of the exposed surface of the exterior layer of the panels is labor intensive, and, with skyrocketing wage rates, labor can be a significant portion of the total cost of built-up roofing. In addition, a quality built-uproofing assembly requires a certain amount of craftsmanship to insure leak-free operation for reasonable period of time. The National Bureau of Standards, in its publication entitled "The Effect of Moisture on the Heat Transfer Performance of Insulated Flat-Roof Construction," Building Science Series No. 37, listed "a steadily worsening quality of workmanship" as one of the primary reasons for a deterioration in the average quality of built-up-roofing in the past few years. This same publication suggests that poor workmanship, along with certain material quality and construction factors, causes most built-up roofs to leak within two years, certainly an unacceptably short period of time. The use of pre-finished roof deck panels or those which would require a minimum of high-cost labor for installation is thus a highly desirable and much sought after goal in the construction industry and is an object of the present invention.

Although a steadily worsening in the quality of asphalt and roofing felt was another factor mentioned in the Bureau of Standards publication, the use of asphalt has additional drawbacks. Hot asphalt is difficult to apply in extreme temperature conditions, and increasing pollution control and health safety requirements are making it more difficult and expensive to work with. Also, fire underwriters would prefer to eliminate asphalt entirely from roof decks but are reluctant to press for revised building codes until equal or lower cost alternatives are available.

Alternative sheet materials presently available in the market are either too costly or lack the capacity to accommodate significant expansion and shrinkage of the sheets in response to temperature changes while retaining water-impermeability. This latter factor becomes critical in structures such as shown in Payne, or applicants' own invention, wherein insulation is positioned directly beneath the sealing layers. This preformed insulation facilitates unit body construction but causes greater temperature extremes at the sealing surface, with consequently more severe thermal expansion and contraction of that surface taking place. A construction product utilizing materials other than layered asphalt felt or any asphaltic sealer but having the capacity to accommodate significant expansion and contraction would be expected to make a significant contribution to the building industry and is another object of the present invention.

SUMMARY OF THE INVENTION

To achieve the foregoing objects and in accordance with the purpose of the invention, as embodied and broadly described herein, the construction material in sheet form of this invention having at least two moisture barriers comprises a water-impermeable layer of a foamed resinous composition; an interior-facing layer of a mineral-based composition, the inner surface of the interior-facing layer being fixedly adhered to one side of the foamed layer; and a weatherable exterior-facing layer of a water-impermeable synthetic composition having a base selected from the group consisting of non-asphaltic elastomeric, elasto-plastic, and plastic materials, the inner surface of the exterior-facing layer being fixedly adhered to the other side of the foamed layer, the exposed surface of said exterior-facing layer being prefinished. Preferably, the interior-facing layer exposed surface is also prefinished.

As used in this description and in the claims that follow, the term "water-impermeable" is taken to mean impermeable to water in liquid form but semi-impermeable to water in vapor form.

It is also preferred that the exterior-facing layer is reinforced with fiber material such as asbestos fiber, glass fiber, resin-coated organic fiber, and resin-impregnated organic fibers, and that the foamed layer is foamed urethane. It is also preferred that the thickness of the interior-facing layer is substantially from 0.5 to 1.0 inches; the thickness of the exterior-facing layer is substantially from 0.005 to 0.250 inches; and the thickness of the foamed layer is substantially from 0.5 to 3.0 inches.

And it is also preferred that the construction material in sheet form has mitered edges, the mitering extending through the exterior-facing layer and into the foamed layer, the mitered edges forming a joint cavity when abutted.

Also in accordance with the purpose of the invention, as embodied and broadly described herein, the method of joining sheets of a construction material, each of the sheets having an intermediate foamed layer, and interior-facing layer, an exterior-facing layer, and having mitered edges forming a joint cavity when abutted, the foamed layer being exposed for bonding at the mitered edges, comprises the steps of positioning the sheets with the mitered edges abutting on opposite sides of the stem of a bulb-T rafter, the sheets being supported by the cross-member of the bulb-T rafter; forming a resilient water-impermeable foamed resinous filler in the joint cavity, the foamed material having at least a 30% expansion and contraction capacity, the foamed material firmly adhering to, and forming a water-impermeable bond with, the foamed layers of the abutted sheets; and sealing the filled joint cavity with weatherable tape, the tape being of a water-impermeable resilient material and having at least a 30% expansion and contraction capacity, the tape firmly adhering to, and forming a water-impermeable bond with, the exterior-facing layers of the abutted sheets and the foamed material.

Preferably, the method of joining further comprises the step of forming a gasket between the bulb-T cross-member and the interior-facing layer of the abutted sheets when the sheets are being positioned. It is also preferred that the resilient foamed water-impermeable filler is foamed urethane.

Also in accordance with the purpose of the invention, as embodied and broadly described herein, the roof deck having at least two water barriers for assembly with a roof structure utilizing bulb-T rafters comprises at least two sheets of a construction material as hereinbefore described, the sheets having mitered edges exposing the foamed layers for bonding and forming a joint cavity when abutted, and the sheets formed in edge-abutting relationship on opposite sides of the stem of one of the bulb-T rafters, the cross-member of the bulb-T rafter supporting the sheets; a foamed resinous resilient moisture-impermeable filler formed in the joint cavity and bonded to the exposed foamed layers; and a weatherable moisture-impermeable sealing tape covering the filled joint cavity and being firmly bonded to the exterior-facing layers and to the foamed filler. Preferably, the roof deck further comprises a gasket formed between the bulb-T cross-member and the interior-facing layers of the abutted sheets. It is also preferred that both the foamed layers of the construction material and the foamed filler are foamed urethane.

The accompanying drawings, which are incorporated in, and constitute a part of this specification, illustrate embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
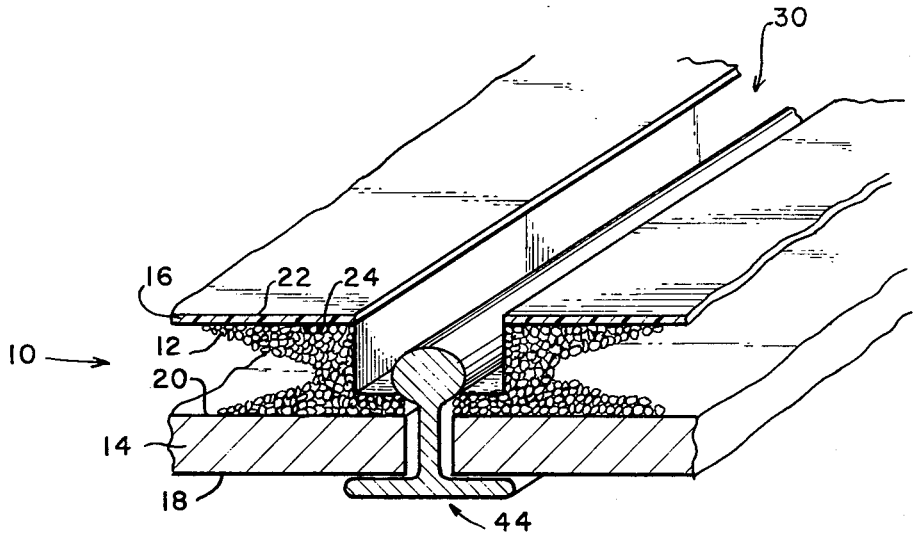
FIG. 1 is a perspective view of abutted sheets of a construction material fabricated in accordance with the invention. The FIGURE also shows a conventional bulb-T rafter interposed between the mitered edges of the abutted sheets.

Referring now to FIG. 1, and in accordance with the present invention, it may be seen that the construction material in sheet form 10 which is useful for fabricating roof decks includes a water-impermeable intermediate foamed layer 12, an interior-facing layer 14, and a water-impermeable exterior-facing layer 16, which arrangement affords at least two water barriers between the interior and exterior environments. As herein embodied, each construction sheet has at least one mitered edge 30 wherein the mitering extends through the exterior-facing layer 16 and into the foamed layer 12. The mitered edges of the sheet are also formed to create a joint cavity when the edges are abutted.

In accordance with the present invention, the foamed intermediate layer 12 is formed from a foamed resinous composition. As herein embodied, the foamed layer preferably is foamed urethane, a substance having an excellent insulating capacity by virtue of its high specific insulation value. Even small thickness of foamed urethane are water-impermeable because of its tightly packed, closed cell consistency. Foamed urethane also has a substantially constant density and is not susceptible to "settling" or "packing" like standard glass wool insulation. And, by virture of the appreciable rigidity caused by its multicellular consistency, it is able to support the overlying structural sheet member without the need for reinforcing ribs. Preferably, the thickness of the foamed layer 12 will be from about 0.5 to about 3.0 inches, which range will allow adequate insulating capacity for the usual construction applications and for a choice of a suitable foamed resinous composition such as foamed urethane.

In accordance with the invention, the interior-facing layer 14 is composed of a mineral-based composition and has an exposed surface 18 and an inner surface 20, which inner surface is fixedly adhered to one side of the intermediate foamed layer 12. As herein embodied, the interior-facing layer 14 is a substantially rigid board fabricated from a resinous binder and a perlite filler. The mineral-based composition can also be standard gypsum-based materials or any of the newer glass fiber-reinforced gypsum construction materials such as described in various references including British Pat. No. 1,204,541.

In an application using a foamed urethane layer with a standard gypsum-based interior-facing layer, the freshly foamed urethane itself was found to satisfactorily adhere to the gypsum layer. Bonding between layers 12 and 14 also can be accomplished with the use of conventional synthetic glues and adhesives that are compatible with the mineral-based and foamed materials including acrylic, butyl, neoprene, styrene-butadiene, and polyvinylchloride (PVC) adhesives. The water-impervious characteristic of such synthetic cements, when used, adds yet another water barrier to the construction material 10.

Preferably, the exposed surface 18 is prefinished which, along with the acoustical insulating and fire-resistant properties of these mineral-based materials, enables the sheet to be used as the sole ceiling member for some applications. Substantial cost savings can result in these instances due to the elimination of a false ceiling. Preferably the thickness of the mineral-based interior-facing layer 14 is from about 0.5 to 1.0 inches, and this range will suffice for most applications wherein gypsum, glass fiber-reinforced gypsum, or perlite-filled materials are used.

In accordance with the invention, the water-impermeable exterior-facing layer 16 has a prefinished exposed surface 22 and an inner surface 24 which is fixedly adhered to the other side of foamed layer 12 from the interior-facing layer 14. Exterior-facing layer 16 is composed of a fabric-backed weather-resistant material selected from the group of non-asphaltic elastomeric, elasto-plastic and plastic materials including, but not limited to, TEDLAR, PVC, urethane, butyl, neoprene, styrene-butadiene, acrylic latex and silicone-based polymers. TEDLAR is a registered trademark of E. I. du Pont de Nemours and Company. The use of non-asphaltic exterior-facing layers is an important element of the present invention, as many of the aforementioned problems associated with asphalt or asphalt-based exterior finishing materials are eliminated. The resulting installed roofing cost is comparable to asphalt built-up roofing even though the cost per pound of the synthetic materials is generally higher when compared to asphaltic materials.

Exterior-facing layer 16 can be bonded to the foamed layer using freshly foamed urethane or any of the conventional commerial glues and adhesives mentioned previously that are compatible with the exterior-facing layer material and the foamed material. For instance, using a foamed urethane intermediate layer and an exterior-facing covering of fabric-backed TEDLAR, the freshly foamed urethane was found to bond satisfactorily. When adhesives are used, they add yet another water barrier to the assembled construction sheet 10. As embodied herein, exterior-facing layer 16 material is reinforced with fibers such as asbestos fibers, glass fibers, resin-coated organic fibers, and resin-impregnated organic fibers to provide increased structural rigidity for certain applications calling for significant roof-loading as, for instance, in areas with heavy snowfall.

Paper or felt impregnated or coated with a stabilizing resin such as polyethylene neoprene, or butyl are examples of the resin-coated or impregnated organic fibers that can be used. The fibers are incorporated directly into the exterior-facing layer material when it is formed and are not a part of the fabric backing.

Preferably, the thickness of the exterior-facing layer 16 is from about 0.005 to 0.250 inches. This thickness range is considerably thinner than asphalt-coated built-up roofing applications using standard roofing felt. Hence, the use of less synthetic material volume in applicants' novel construction helps to offset the higher per pound material cost for synthetics.

Figure 2:
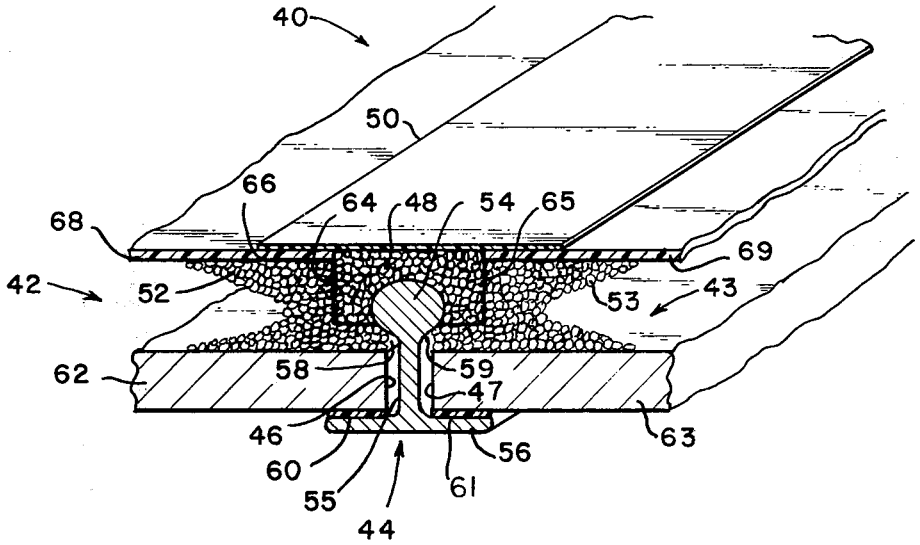
FIG. 2 is a perspective view of a portion of a completed roof deck composed of sheets of a construction material and a joint, including a bulb-T rafter, both the construction material and joint being formed in accordance with the present invention.

With particular reference to FIG. 2, and also in accordance with the present invention, there is shown a portion of a roof deck 40 including at least two sheets 42 and 43 of a construction material, the sheets formed in edge-abutting relation, a bulb-T rafter 44 interposed between the abutted edges 46, 47, a water-impermeable foamed filler 48, a water-impermeable sealing tape 50. Sheets 42, 43 are formed, as hereinbefore described, with edges 46, 47 being mitered to expose the foamed layers 52, 53 for bonding and for forming a joint cavity when abutted. The aforementioned components are joined and assembled in accordance with the invention as hereinafter described.

In accordance with the present invention, a bulb-T rafter 44 is interposed between the abutted edges 46, 47 of sheets 42, 43. Bulb-T rafters are generally manufactured from structural material such as steel. In cross section, the bulb-T shaped rafter has a generally circular bulb-like member 54 formed at the end of the stem 55 of the inverted "T" shaped body with the cross-member 56. Bulb-T shaped rafters as shown in FIGS. 1 and 2 are known in the industry.

The bulb-T rafter 44 serves to space the abutting sheets and to support the weight of the assembled roof deck. The diameter of the bulb member 54, the length of the stem 55 and the depth of the unmitered portion of the abutting edge will determine the separation of the sheets when contact between the sheet edge and the bulb 54 at the edge corners 58, 59 occurs. As installed, some separation between the edges 46, 47 (as seen in FIGS. 1 and 2) is necessary to allow for thermal contraction and to prevent buckling. However, it may be advisable to have some initial compression of the foamed layer at the bulb-foam interface to prevent subsequent thermal contraction from breaking the contact seal at corners 58, 59.

As embodied herein, gaskets 60, 61 can be formed between cross-member 44 and the interior-facing layers 62, 63 of sheets 42, 43 to provide a further water barrier for the joint. Conventional gasket-forming material compatible with the rafter and interior-facing layer materials can be utilized, with the gasket material applied at the time the sheets of the construction material are laid on the rafters. For a rafter fabricated from steel and a mineral-based interior facing layer, a gasket of butyl, neoprene, urethane, silicone, PVC or polyethylene will provide adequate sealing while retaining enough flexibility to permit thermal expansion and contraction.

In accordance with the invention, the foamed filler 48 is composed of a foamed resinous composition formed in the joint cavity bounded, in part, by the mitered surfaces 64, 65 of abutted edges 46, 47 and the bulb 54 of rafter 44. Foamed filler 48 is water-impermeable, serving as one of the two main water barriers for the joint, and, as it is formed in the cavity, also bonds to the exposed foam layers 52, 53 of sheets 42, 43 to provide a continuous water-inpermeable barrier. Foamed filler 48 is also resilient, having at least a 30% thermal expansion and contraction capacity. As herein embodied, both the foamed layers 52, 53 and the foamed filler 48 are foamed urethane. When urethane is foamed in place, during the forming of the filler 48, it has a self-adhesive property whereby an excellent water-impermeable bond is produced with already-formed exposed foamed urethane.

In accordance with the invention, a weatherable tape 50 is utilized to cover the joint cavity, the sealing surface 66 of tape 50 forming a water-impermeable bond with the exterior-facing layers 68, 69 of sheets 42 and 43 and with the foamed filler 48. Sealing tape of the type utilized in the present invention can be fabricated from a thin layer of the same material used for the exterior-facing layers also with a fabric backing. The tape can be fabricated with an adhesive backing to facilitate its application. Tape 50 along with moisture-impermeable exterior-facing layers 68, 69 together form the other of the two primary water barriers for the roof deck joint. Tape 50 is also resilient, having at least a 30% expansion and contraction capacity, and, together with the other aforementioned components of the joint, serves to create a small water-impermeable expansion joint at regular intervals in the roof deck, thereby preventing unacceptable stresses from building up in response to thermal transients or wind pressure, which stresses may cause material failure and breach the moisture barrier.

It will be apparent to those skilled in the art that various modifications and variations could be made in the construction material, in the method of joining sheets of a construction material, and in the roof deck disclosed or otherwise shown herein without departing from the scope or spirit of the invention.

What is claimed is:

1. A method of joining and spacing preformed sheets of a construction material each of said sheets having a water-impermeable intermediate foamed layer, a mineral-based interior-facing layer, and a water-impermeable exterior-facing layer, and said sheets also having mitered edges for forming a joint cavity when abutted, each of said mitered edges having an unmitered face and a first mitered face both perpendicular to the plane of said sheets and a second mitered face parallel to the plane of said sheets, said second mitered face connecting said unmitered face with said first mitered face, said foamed layer being exposed for bonding at said first and second mitered faces, said method comprising the steps of:

a. positioning said sheets with said mitered edges abutting on opposite sides of the stem and bulb of a bulb-T rafter, said sheets being supported by the cross-member of said bulb-T rafter, the corners formed by the intersection of said unmitered and said second mitered faces contacting the lower surfaces of the ball of said bulb-T rafter to space said unmitered faces a predetermined distance from the stem;

b. forming a resilient water-impermeable foamed resinous filler in said joint cavity, said foamed filler filling said joint cavity and substantially capturing the bulb portion of said bulb-T rafter, said foamed material having at least a 30% expansion and contraction capacity, said foamed filler also firmly adhering to, and forming a water-impermeable bond with, said foamed layers of said abutted sheets; and c. sealing said filled joint cavity with weatherable tape, said sealing tape being of a water-impermeable resilient material and having at least a 30% expansion and contraction capacity, and said tape firmly adhering to, and forming a water-impermeable bond with, said exterior-facing layers of said abutted sheets and with said foamed filler.

2. The method of joining sheets of construction material of claim 1 further comprising:

a. forming a gasket between said bottom support flange and said interior-facing layers of said abutted sheets when said bulb-T closure rafter is being interposed.

3. The method of joining sheets of construction material of claim 1 wherein said resilient water-impermeable foamed resinous filler is foamed urethane.

4. A roof deck having at least two water barriers or assembly with a roof structure utilizing bulb-T rafters, said roof deck comprising:

a. at least two sheets of a preformed construction material positioned in edge-abutting relationsip on opposite sides of the stem and bulb of one of said bulb-T rafters, the cross-member of said bulb-T rafter supporting said sheets, each of said sheets having:

i. a water-impermeable layer of a foamed resinous composition;

ii. an interior-facing layer of a mineral-based composition, the inner surface of said interior-facing layer being fixedly adhered to said foamed layer;

iii. a weatherable water-impermeable exterior-facing layer of a synthetic composition having a base selected from the group consisting of non-asphaltic elastomeric, elasto-plastic, and plastic materials, the inner surface of said exterior-facing layer being fixedly adhered to said foamed layer, and the exposed surface of said exterior-facing layer being prefinished; and iv. mitered edges for forming a joint cavity when abutted, each of said mitered edges having an unmitered face and a first mitered face both perpendicular to the plane of said sheets and a second mitered face parallel to the plane of said sheets, said second mitered face connecting said unmitered face with said first mitered face, said foamed layers being exposed for bonding at said first and second mitered faces, and the corners formed by the intersection of said unmitered and said second mitered faces contacting the lower surfaces of the ball of said bulb-T rafter to space said unmitered faces a predetermined distance from the stem;

b. a foamed resinous resilient water-impermeable filler formed in said joint cavity and bonded to said exposed foamed layers of said abutted sheets, said foamed filler substantially capturing the bulb portion of said bulb-T rafter, said foamed filler also having at least a 30% expansion and contraction capacity; and c. a weatherable sealing tape of a water-impermeable resilient material and having at least 30% expansion and contraction capacity, said tape covering said filled joint cavity and being firmly adhered to said exterior-facing layers of said abutted sheets and to said foamed filler.

5. The roof deck as in claim 4 wherein:

a. said foamed resinous composition is foamed urethane; and b. said foamed filler is foamed urethane.

6. The roof deck as in claim 4 wherein:

a. each of said interior-facing layers has a thickness of substantially from 0.5 to 1.0 inches;

b. each of said exterior-facing layers has a thickness of substantially from 0.005 to 0.250 inches;

c. each of said foamed layers has a thickness of substantially from 0.5 to 3.0 inches.

7. The roof deck as in claim 4 wherein each of said exterior facing layers is reinforced with fibers selected from the group consisting of asbestos fibers, glass fibers, resin-coated organic fibers, and resin-impregnated organic fibers.

8. The roof deck as in claim 4 further comprising a gasket formed between said cross-member of said rafter and said interior-facing layers of said abutted sheets, said gasket providing another water barrier.

* * * * *